US009850801B2

(12) United States Patent
Watanabe et al.

(10) Patent No.: US 9,850,801 B2
(45) Date of Patent: Dec. 26, 2017

(54) PISTON COOLING STRUCTURE IN COMBUSTION ENGINE

(71) Applicant: Kawasaki Jukogyo Kabushiki Kaisha, Hyogo (JP)

(72) Inventors: Hiroyuki Watanabe, Kobe (JP); Hisatoyo Arima, Himeji (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 67 days.

(21) Appl. No.: 14/839,550

(22) Filed: Aug. 28, 2015

(65) Prior Publication Data

US 2017/0058751 A1 Mar. 2, 2017

(51) Int. Cl.
*F01P 3/08* (2006.01)
*F01P 11/04* (2006.01)

(52) U.S. Cl.
CPC ..... *F01P 3/08* (2013.01); *F01P 11/04* (2013.01)

(58) Field of Classification Search
CPC ..... F02P 3/08; F01P 11/04
See application file for complete search history.

(56) References Cited

U.S. PATENT DOCUMENTS 4,010,718 A * 3/1977 Stewart ..... F01M 1/08 123/41.35
2004/0040520 A1* 3/2004 Bontaz ..... F01P 3/08 123/41.35
2013/0160724 A1 6/2013 Yamamoto et al.

FOREIGN PATENT DOCUMENTS

JP 2013-130129 A 4/2013

* cited by examiner

*Primary Examiner* — Kevin A Lathers

(57) ABSTRACT

A piston cooling structure for an engine includes a first nozzle and a second nozzle for injecting a cooling liquid towards a back face of a piston that reciprocally move within a cylinder bore along a cylinder axis line. The first angle of inclination of an axis of the first nozzle relative to the cylinder axis line is set to be smaller than the second angle of inclination of an axis of the second nozzle relative to the cylinder axis line.

18 Claims, 9 Drawing Sheets

PISTON COOLING STRUCTURE IN COMBUSTION ENGINE

BACKGROUND OF THE INVENTION

Field of the Invention

The present invention relates to a piston cooling structure in a combustion engine of a kind in which a piston back face is cooled with the utilization of a cooling liquid such as, for example, cooling oil.

Description of Related Art

The JP Laid-open Patent Publication No. 2013-130129, for example, discloses a structure in which the cooling liquid is jetted towards a piston back face in a direction substantially parallel to the cylinder axis line. According to this patent document, a to-be-cooled portion of the piston back face, which the cooling liquid is brought into contact with, is effectively cooled, but it is difficult to suppress the temperature rise that occurs in any other portion of the piston back face, which departs from the to-be-cooled portion of the piston back face.

SUMMARY OF THE INVENTION

In view of the foregoing, the present invention has been devised to provide a piston cooling structure which is effective to suppress the temperature rise occurring in a wide range of portions of the piston back face.

In order to accomplish the above described object of the present invention, the present invention provides a piston cooling structure for a combustion engine which includes first and second nozzles configured to inject a cooling liquid towards a back face of a piston which reciprocatingly move along a cylinder axis line within a cylinder bore. The first and second nozzles have respective axes that are inclined at first and second angles relative to the cylinder axis line. Also, the first angle of inclination relative to the cylinder axis line is set to a value smaller than the second angle of inclination relative to the cylinder axis line. It is to be noted that the "back face of the piston or piston back face" referred to above and hereinafter is intended to mean a face of the piston opposite to a top face forming a bottom face of a combustion chamber. Also, the first angle of inclination may be zero degree (0°), that is, the axis of the first nozzle may extend parallel to the cylinder axis line.

According to the present invention, the first angle of inclination is set to a value smaller than the second angle of inclination of the second nozzle. Accordingly, the first nozzle, as compared with the second nozzle, can continue injecting the cooling liquid towards a specific site of a back face of the piston regardless of the position of the piston which undergoes a reciprocating movement. On the other hand, the second nozzle, as compared with the first nozzle, can inject the cooling liquid towards a wide range of the back face of the piston while the position of the cooling liquid, which is blown towards the back face of the piston, changes in dependence on the position of the piston that undergoes the reciprocating movement. Thus, of the back face of the piston, while the cooling liquid is kept being injected intensively towards the specific site, the cooling liquid is injected to the wide range of the back face of the piston. Therefore, the temperature rise occurring in a wide range of the back face of the piston can be suppressed.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF PREFERRED EMBODIMENTS

The present invention will now be described in detail in connection with a preferred embodiment thereof with reference to the accompanying drawings. Before the description proceeds, it is to be noted that the term "left and right" used hereinabove and hereinafter are to be understood as relative terms descriptive of positions and/or direction as viewed from a motorcycle rider occupying the seat during the forward travel of the motorcycle.

Figure 1:
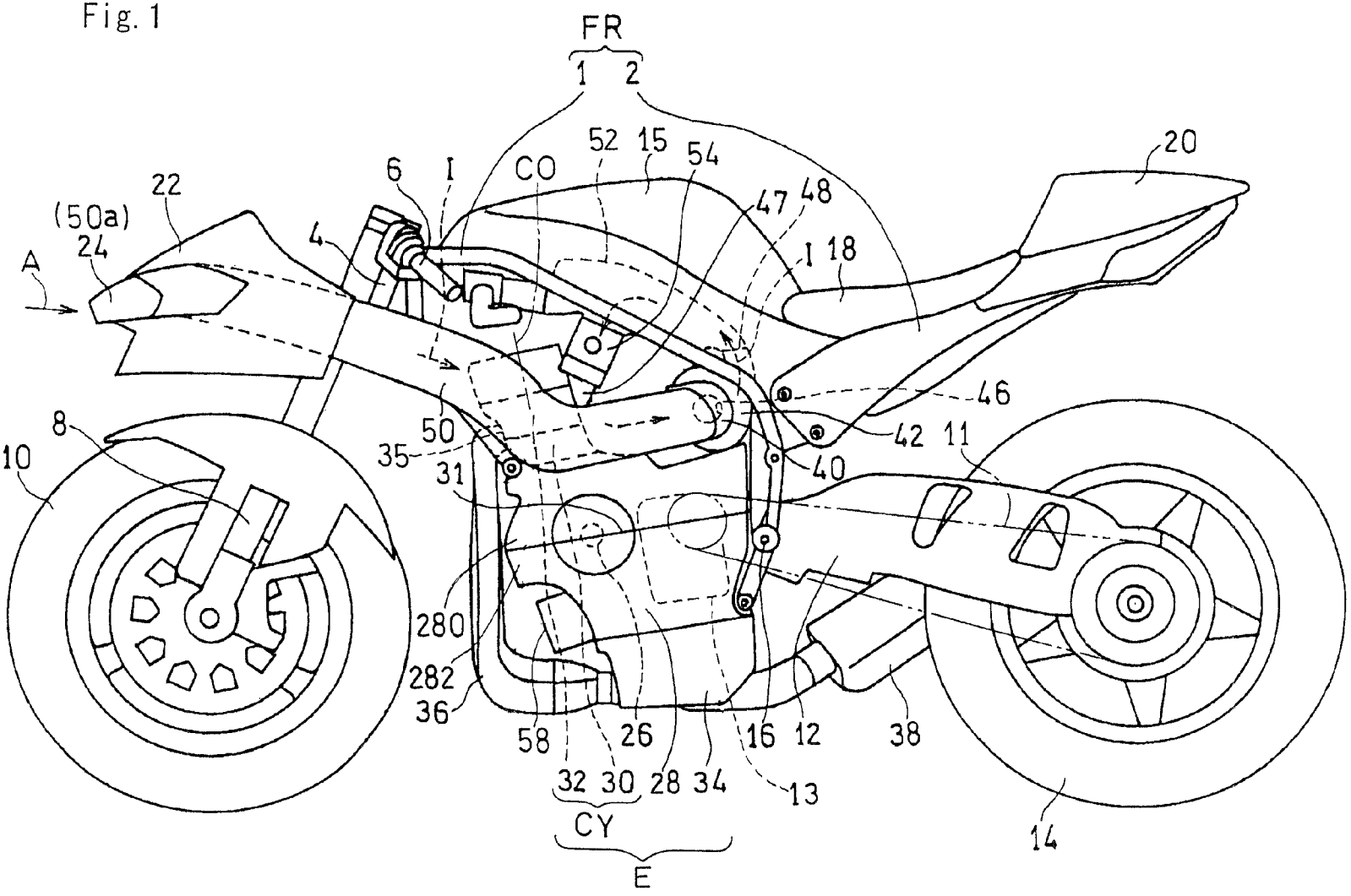
FIG. 1 is a schematic side view of a motorcycle having a combustion engine equipped with a piston cooling structure designed in accordance with a preferred embodiment of the present invention.

FIG. 1 shows a schematic side view of a motorcycle having mounted thereon a combustion engine equipped with a piston cooling structure designed in accordance with the preferred embodiment of the present invention. The illustrated motorcycle includes a motorcycle frame structure FR made up of a main frame 1, forming a front half portion of the motorcycle frame structure FR, and a seat rail 2 connected rigidly with a rear portion of the main frame 1 and forming a rear half portion of the motorcycle frame structure FR. A front fork 8 is rotatably supported by a head pipe 4, provided at a front end of the main frame 1, through a steering shaft (not shown), and a front wheel 10 is fitted to this front fork 8 in any known manner. A handlebar 6 for steering purpose is fixed to an upper end portion of the front fork 8 also in any known manner.

On the other hand, a swingarm 12 is supported at a rear end portion of the main frame 1, which is a lower intermediate portion of the motorcycle frame structure FR, through a pivot pin 16 for movement up and down, and a rear wheel 14 is rotatably supported at a rear end portion of the swingarm 12. The main frame 1 has a lower portion to which a combustion engine E is fitted. Rotation of the combustion engine E is transmitted through a transmission 13 to a power transmitting mechanism 11 such as, for example, a drive chain, which is disposed on a left side of the motorcycle body. The rear wheel 14 is driven through this power transmitting mechanism 11.

A fuel tank 15 is disposed at an upper portion of the main frame 1 and a seat assembly comprised of a driver's or motorcyclist's seat 18 and a fellow passenger's set 20 is supported by the seat rail 2. Also, a front fairing 22 made of a resinous material is mounted on a front portion of the motorcycle body so as to cover forwardly of the head pipe 4. The front fairing 22 is formed with an air intake opening 24 defined therein for introducing an intake air A therethrough into the combustion engine E.

The combustion engine E referred to above is in the form of a four cylinder, four stroke parallel multi-cylinder engine having a crankshaft 26 which is a rotary shaft and extends in a motorcycle widthwise direction. It is, however, noted that the type of the combustion engine E is not necessarily limited to that described above. The combustion engine E includes a crankcase 28 for supporting the crankshaft 26, a cylinder block 30 connected with an upper portion of the crankcase 28, a cylinder head 32 connected with an upper portion of the cylinder block 30, and an oil pan 34 fitted to a lower portion of the crankcase 28. The oil pan 34 accommodates therein a quantity of lubricant oil OL that concurrently serves as a cooling liquid.

The crankcase 28 has a rear portion forming a transmission casing for accommodating the transmission 13 therein. This crankcase 28 is of a split type casing having a split interface 31 and made up of a casing upper half body 280 and a casing lower half body 282 that are positioned on respective opposite sides of the split interface 31. The cylinder block 30 and the cylinder head 32 cooperate with each other to define an engine cylinder CY of the combustion engine E. Each of the crankcase 28, the cylinder block 30 and the cylinder head 32 is in the form of a molded product formed by die casting of aluminum or aluminum alloy. In the practice of this embodiment of the present invention, the casing upper half body 280 of the crankcase 28 and the cylinder block 30 are formed integrally with each other by the use of any known die forming.

The engine cylinder CY is somewhat tilted. Specifically, the engine cylinder CY has an axis line C0 extending upwardly and tilted forwardly. The cylinder head 32 has a rear portion provided with air intake ports 47. Four exhaust pipes 36 fluid connected with exhaust ports 35 defined in a front surface of the cylinder head 32 are merged together at a location beneath the combustion engine E and is then fluid connected with an exhaust muffler 38 that is disposed on a right side of the rear wheel 14. A supercharger 42 for sucking an external air as an intake air I and then supplying it into the combustion engine E is disposed rearwardly of the cylinder block 30 and above a rear portion of the crankcase 28.

The supercharger 42 serves to compress the external air sucked through an air suction port 46, and then to discharge it via a discharge port 48 after having increased the pressure of the air, thereby to finally supply it into the combustion engine E. Accordingly, the amount of the intake air to be supplied to the combustion engine E is increased to enhance the engine output.

The supercharger 42 employed in the practice of this embodiment of the present invention is a centrifugal supercharger and has a centrifugal impeller (not shown) fixed to a supercharger rotary shaft (not shown) that extends in the motorcycle widthwise direction. However, the specific supercharger 42 is not necessarily limited to that shown and described above, and any known supercharger can be employed.

The air suction port 46 of the supercharger 42 is fluid connected with an outlet of an air cleaner 40 that is disposed on an upstream side of the supercharger 42, and an air intake duct 50 for introducing an incoming air A into the supercharger 42 is fluid connected with an inlet of the air cleaner 40. The air intake duct 50 has a front end opening 50*a* defined therein and is supported by the main frame 1 with the front end opening 50*a* positioned in face to face relation with the air intake opening 24. Accordingly, the incoming wind A introduced through the front end opening 50*a* can be increased in pressure by the known ram effect before it is introduced into the air cleaner 40 as the intake air I. The air cleaner 40 serves to substantially purify the intake air I that is introduced through the air intake duct 50. The intake air I which has been substantially purified by the air cleaner 40 is sucked into the supercharger 42.

An intake air chamber 52 is disposed between the discharge port 48 of the supercharger 42 and the air intake port 47 of the combustion engine E. This intake air chamber 52 reserves therein a quantity of the intake air I to be supplied to the air intake port 47. A throttle body 54 is disposed between the intake air chamber 52 and the cylinder head 32. In this throttle body 54, fuel is injected into the intake air so as to form an air-fuel mixture which is in turn supplied into the engine cylinder CY in any known manner. The fuel tank 15 referred to previously is disposed above the intake air chamber 52 and the throttle body 54.

Figure 4:
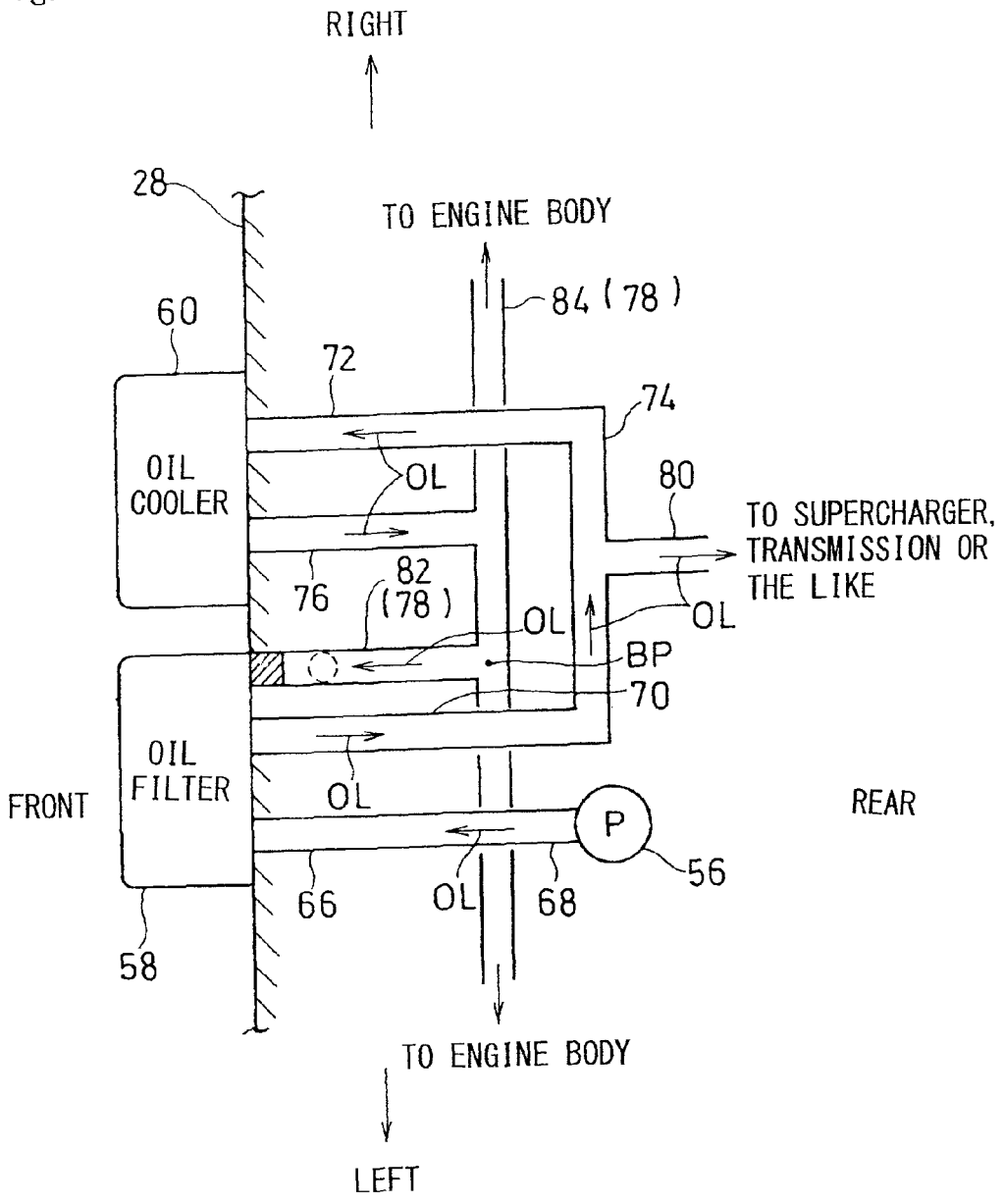
FIG. 4 is a diagram showing a portion of the engine cooling structure.

As shown in FIG. 4, the combustion engine E also includes an oil pump 56 for supplying oil OL within the oil pan 34 (shown in FIG. 1) under pressure to various parts of the combustion engine E, an oil filter 58 disposed on a downstream side of the oil pump 56 for substantially purifying the oil OL, and an oil cooler 60 disposed on a downstream side of the oil filter 58 for cooling the oil OL. The oil filter 58 and the oil cooler 60 are disposed in a front surface 28*a* of the crankcase 28 while juxtaposed relative to each other in a motorcycle widthwise direction (leftward and rightward direction).

Figure 2:
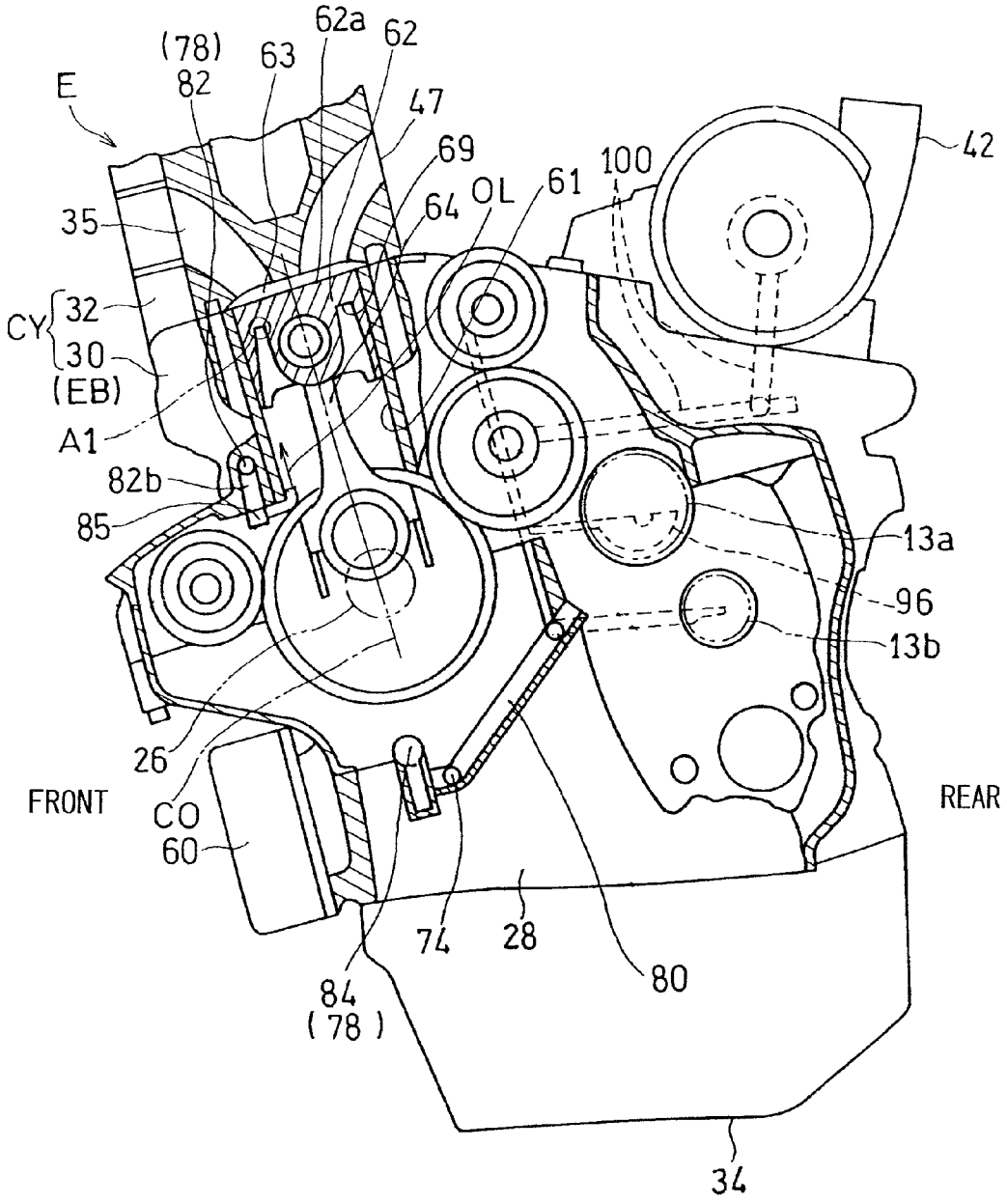
FIG. 2 is a schematic longitudinal sectional view showing, on an enlarged scale, an important portion of the piston cooling structure of the combustion engine.

As shown in FIG. 2, the cylinder CY has a cylinder bore 60 defined therein, and a reciprocating piston 62 is movably accommodated within the cylinder bore 61 with a lower end thereof drivingly connected with the crankshaft 26 through a connecting rod 64. As a matter of course, the piston 62 undergoes a reciprocating movement within the cylinder bore 61 in a direction parallel to the cylinder axis line C0.

As shown in FIG. 4, the oil filter 58 has an inflow passage 66 to which a discharge passage 68 of the oil pump 56 is fluid connected, and also has an outflow passage 70 communicated with an inflow passage 72 of the oil cooler 60 through a filter-cooler communicating passage 74. An outflow passage 76 on a downstream side of the oil cooler 60 is communicated with a cooling passage 78 through which the oil OL is supplied to an engine body.

Between the oil filter 58 and the oil cooler 60, particularly in the filter-cooler communicating passage 74, a lubricant passage 80 for supplying the oil OL to, for example, the transmission 13 and the supercharger 42 is fluid connected. In other words, the oil pump 56 is operable to supply the oil OL commonly to both of the cooling passage 78 and the lubricant passage 80.

The cooling passage 78 includes a first branch passage 82, which is ramified in one way from a point of ramification BP, and a second branch passage 84 which is ramified in the other way from the point of ramification BP. The first branch passage 82 extends forwards (towards an oil filter side) from the point of ramification BP and then extends upwards. On the other hand, the second branch passage 84 extends from the point of ramification BP in a leftward and rightward direction (motorcycle widthwise direction).

Figure 3:
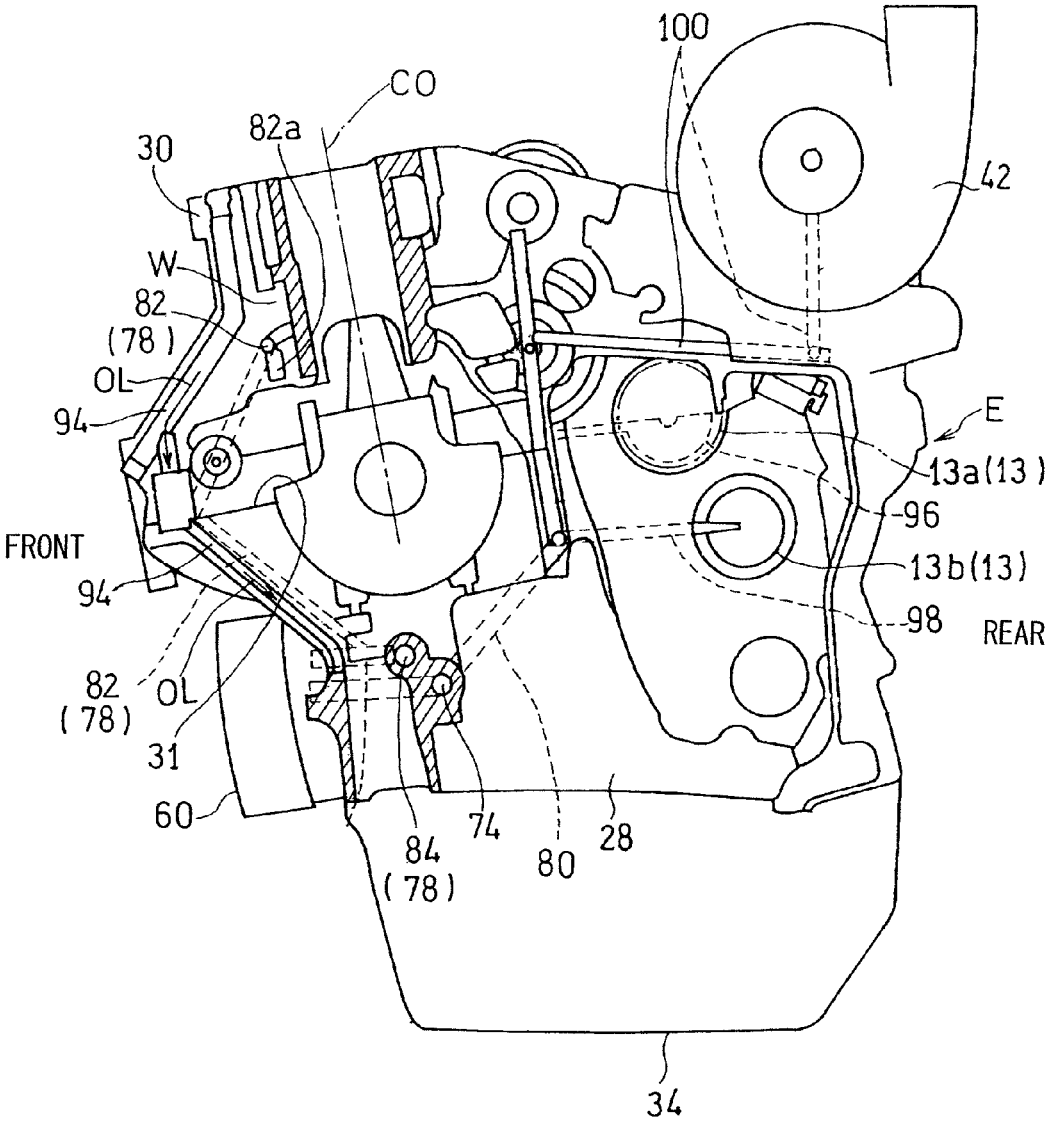
FIG. 3 is a view similar to that shown in FIG. 2, but showing the section taken at a location different from that shown in FIG. 2.
Figure 5:
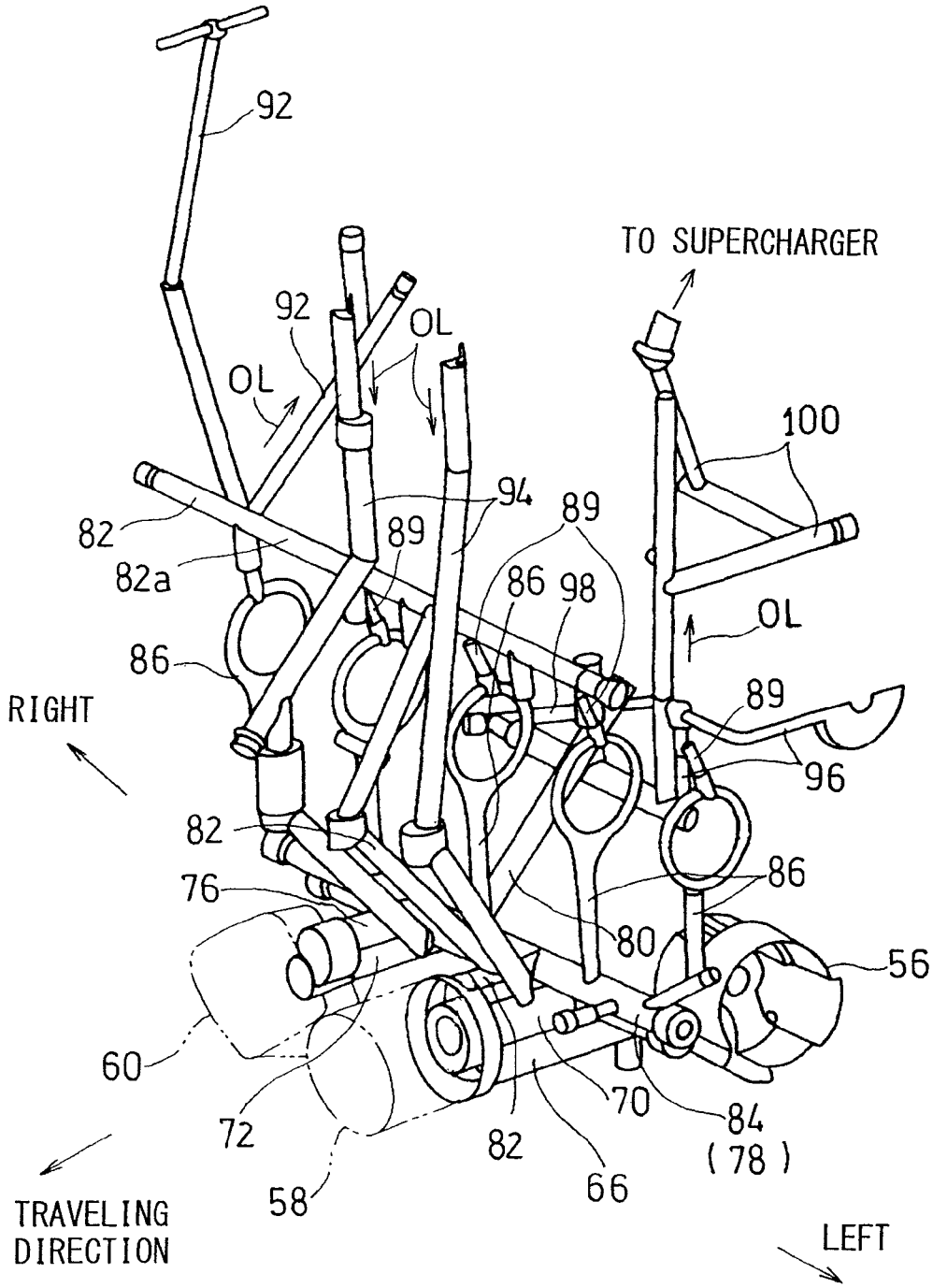
FIG. 5 is a diagram showing the engine cooling structure as viewed in a direction diagonally forwardly and laterally.
Figure 6:
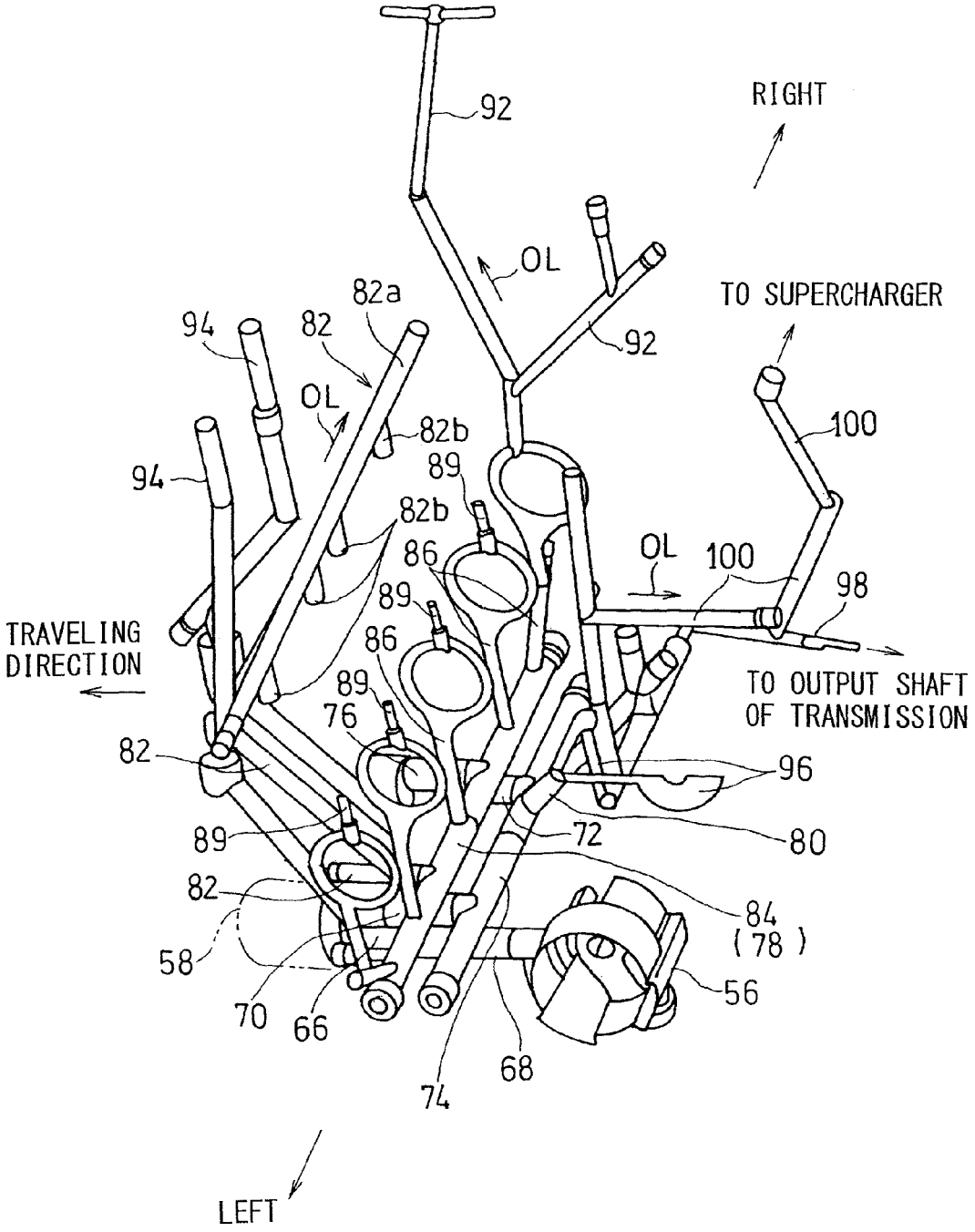
FIG. 6 is a diagram showing the engine cooling structure as viewed in a direction diagonally rearwardly and laterally.

FIGS. 5 and 6 illustrate the lubricant passage formed internally within a wall of the crankcase 28 and a wall of the cylinder block 30. As shown in FIG. 5, the first branch passage 82 extends in the motorcycle widthwise direction after having extended diagonally forwardly and upwardly. Specifically, as shown in FIG. 3, the first branch passage 82 extends diagonally forwardly and upwardly within a wall of the crankcase 28 until reaching the split interface 31, and then extends within a front wall W of the cylinder CY in a leftward and rightward direction.

As shown in FIG. 6, a portion 82*a* of the first branch passage 82, which extends in the leftward and rightward direction, is formed with four outlet passage portions 82*b* which are oriented downwards within the wall of the crankcase 28. A first nozzle 85 for spraying oil as shown in FIG. 2 is fluid connected with an outlet end at a lower end of the outlet passage portion 82*b*. The first nozzle 85 serves to jet the oil OL upwardly from a front surface side of the cylinder CY towards a back face 69 of the piston 62. In other words, the first branch passage 82 forms a cooling passage for piston jetting purpose that is dedicated to jet the oil toward the piston 62. It is to be noted that the "back face 69 of the piston 62 or piston back face 69" referred to above and hereinafter is intended to mean a face of the piston 62 opposite to a top face 62*a* forming a bottom face of a combustion chamber 63. The detail of piston jetting will be discussed later.

As shown in FIG. 5, five crankshaft bearing cooling passages 86 extend upwardly from the second branch passage 84 that extends in the leftward and rightward direction. The crankshaft bearing cooling passage 86 is formed internally within a bearing portion 88 (shown in FIG. 7) in the crankcase 28 shown in FIG. 6 and is used to cool a bearing face of the crankshaft 26.

Figure 7:
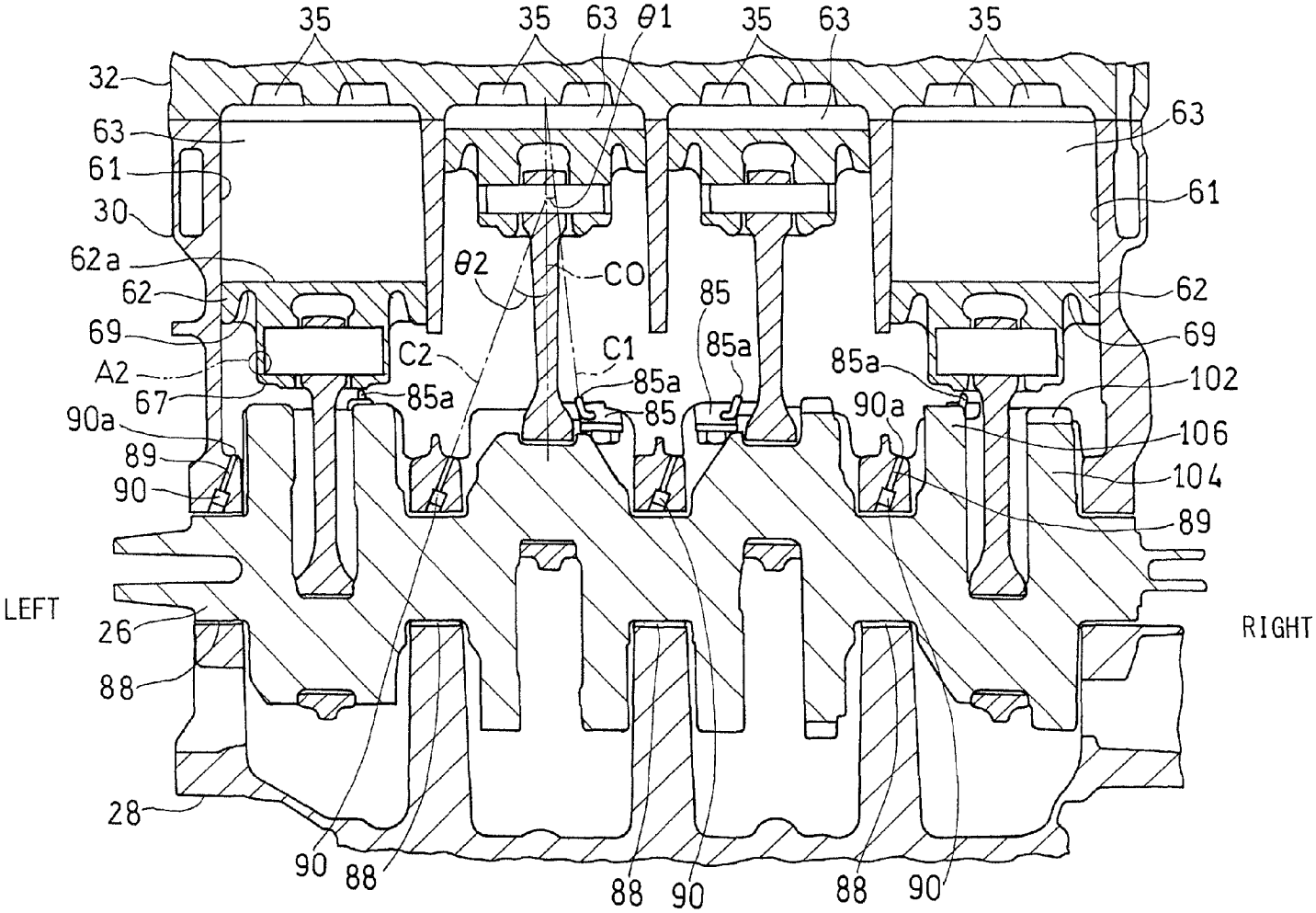
FIG. 7 is a schematic longitudinal sectional view showing the important portion of the combustion engine.

Of the five crankshaft bearing cooling passages 86, the four crankshaft bearing cooling passages 86 on the left side are formed with respective outlet passages 89 that are oriented upwardly. As shown in FIG. 7, each of the outlet passages 89 is fluid connected with a second nozzle 90. This second nozzle 90 serves to jet the oil OL from a side surface side of the cylinder CY upwardly towards the back face 69 of the piston 62. The detail of the piston jetting will be discussed later.

Also, a cylinder cooling passage 92 extends upwards from the crankshaft bearing cooling passage 86 on the rightmost side as shown in FIG. 6. This cylinder cooling passage 92 serves to supply the oil OL to a wall surface of the cylinder CY and a cam chain (not shown) for driving a cam shaft. This cylinder cooling passage 92 is formed within the wall of the crankcase 28 and the wall of the cylinder block 30.

The oil supplied from the cylinder cooling passage 92 to the wall surface of the cylinder CY is returned to an upstream side of the oil cooler 60 on a downstream side of the oil filter 58 after having flown through an oil return passage 94 shown in FIG. 5. Specifically, the oil return passage 94 extends, as best shown in FIG. 3, diagonally forwards and downwards within a front wall of the cylinder block 30, and further extends diagonally rearwardly and downwardly after having passed across the split interface 31 of the crankcase 28. The oil returned from the oil return passage 94 to the upstream side of the oil cooler 60 is, after having been cooled by the oil cooler 60, supplied again to the cooling passage 78.

The lubricating passage 80 referred to previously extends diagonally rearwardly and upwardly within the wall of the crankcase 28 and serves to lubricate the transmission 13, the supercharger 42 and others. Specifically, the lubricating passage 80 extends, as shown in FIG. 5, rearwardly after having been divided into a transmission input shaft lubricating passage 96, a transmission output shaft lubricating passage 98 and a supercharger lubricating passage 100, and serves to supply the oil OL to an input shaft 13*a* of the transmission 13, an output shaft 13*b* of the transmission 13 and the supercharger 42.

The piston jetting will now be described. As shown in FIG. 7, a first angle of inclination θ1 of the axis C1 of the first nozzle 85 relative to the cylinder axis line C0 is so chosen as to be smaller than a second angle of inclination θ2 of the axis C2 of the second nozzle 90 relative to the cylinder axis line C0, that is, $\theta 1<\theta 2$. The first angle of inclination θ1 may be 0° (zero degree), that is, the axis C1 of the first nozzle 85 and the cylinder axis line C0 may be parallel to each other. However, the first angle of inclination θ1 is preferably so chosen as to be within the range of 3 to 11° and, more preferably, within the range of 5 to 9°, but in the practice of this embodiment, the first angle of inclination θ1 is chosen to be about 7°. The second angle of inclination θ2 is preferably so chosen as to be within the range of 15 to 25° and, more preferably, within the range of about 18 to 22°, but in the practice of this embodiment, the second angle of inclination θ2 is chosen to be about 20°.

Figure 8:
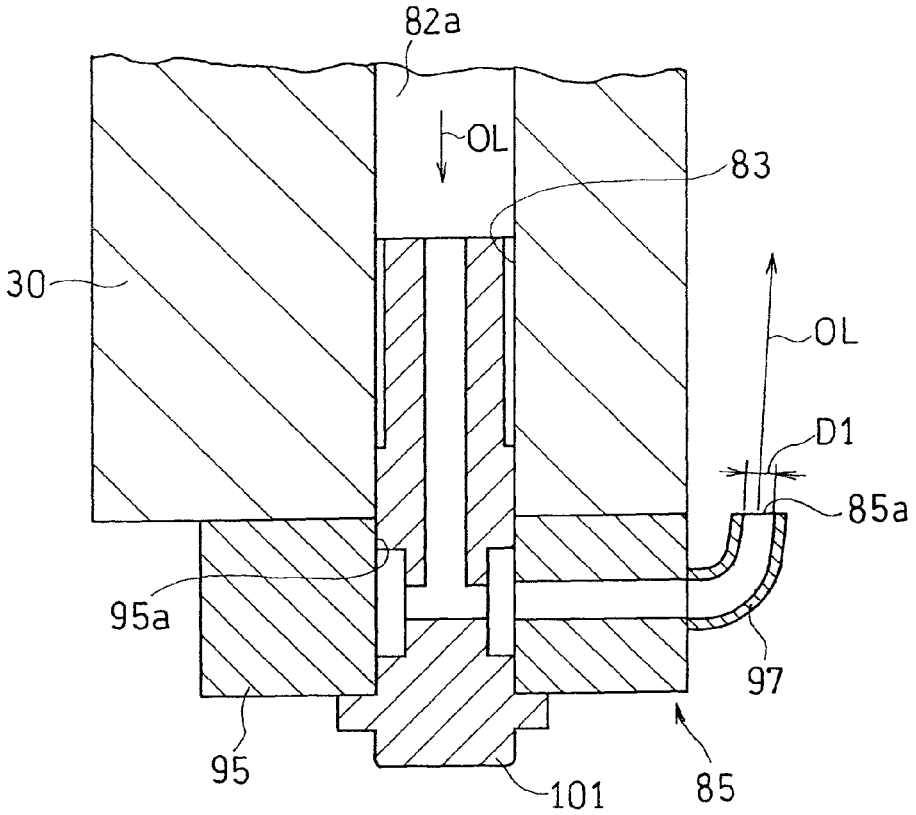
FIG. 8 is a schematic longitudinal sectional view showing a first nozzle of the piston cooling structure.

As shown in FIG. 8, the first nozzle 85 is fitted to the cylinder block 30 by means of a banjo bolt 101. Specifically, the first nozzle 85 includes a hollow disc shaped mounting portion 95 and a pipe 97 fitted to an outer peripheral surface of the mounting portion 95. A tip end of this pipe 97 forms a first injection port 85*a* of the first nozzle 85.

Figure 10:
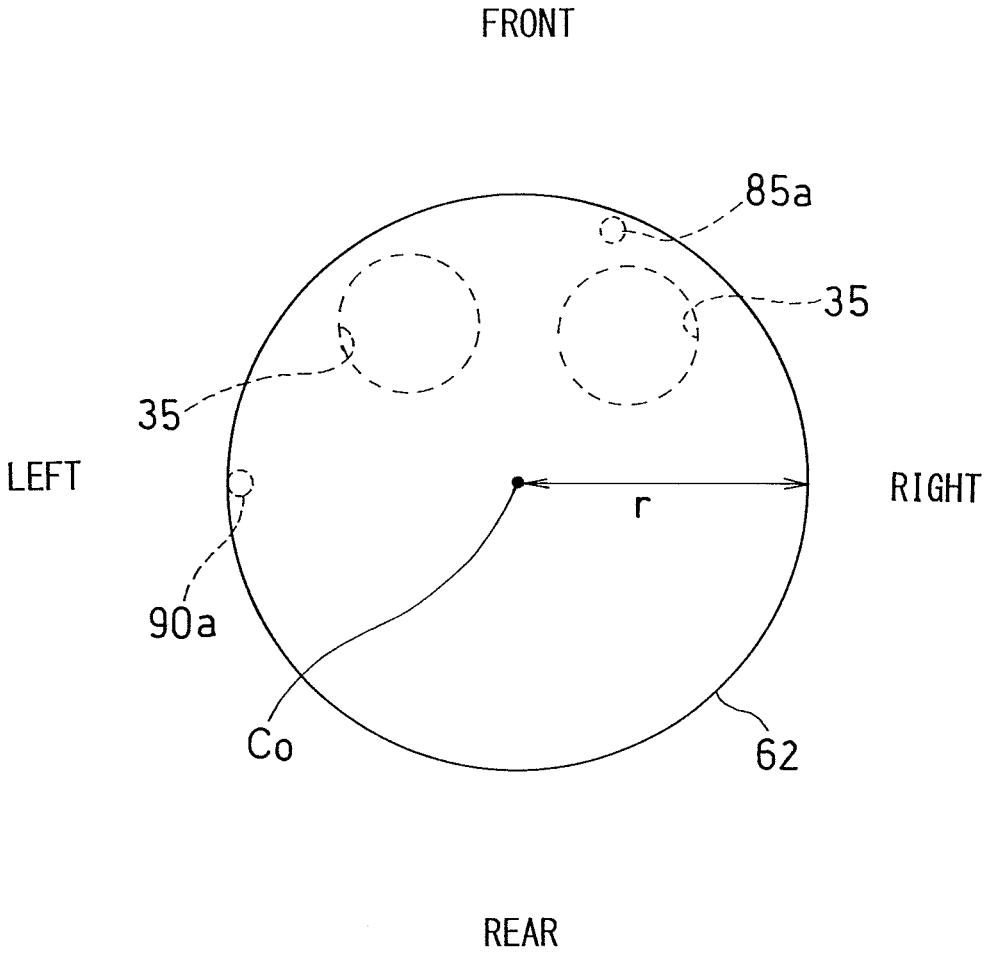
FIG. 10 is a schematic top plan view of a reciprocating piston as viewed from top.

As shown in FIG. 10, the first injection port 85*a* is preferably spaced in a radial direction from the cylinder axis line C0 in the vicinity of the exhaust port 35 a distance within the range of about 0.8 r to 1.0 r and, more preferably, within the range of about 0.85 r to 0.95 r relative to the radius r of the piston 62, but in the practice of this embodiment, the first injection port 85*a* is radially spaced from the cylinder axis line C0 a distance of about 0.9 r.

The position of the first injection port 85*a*, shown in FIG. 7, in the direction parallel to the cylinder axis line C0 is preferably disposed spaced a distance of about 0.05 r to 0.22 r (about 2 to 8 mm) and, more preferably, about 0.08 r to 0.19 r (about 3 to 7 mm) downwardly from a small end portion 67 of the piston 62, then held at the bottom dead center, but in the practice of this embodiment the first injection port 85*a* is spaced a distance of about 0.13 r (about 5 mm) downwardly from the small end portion 67 of the piston 62 then held at the bottom dead center. If this position in the direction parallel to the axis line is chosen as discussed above, the first injection port 85*a* is disposed near the piston 62 and, therefore, the oil OL can be intensively injected onto an injection target portion of the piston 62 without being diffused. In order to maintain the preferred first angle of inclination θ1 and the preferred axis line direction position, the first injection port 85*a* is preferably spaced a distance of about 0.8 r to 1.0 r and, more preferably, about 0.85 r to 0.95 r in the radial direction from the cylinder axis line C0.

With the banjo bolt 101 inserted from below onto a hollow portion 95*a* of the mounting portion 95, the bolt 101 is fastened to a female threaded portion 83, which is formed in the outlet passage portion 82*b* of the first branch passage 82. By so doing, the first nozzle 85 is fitted to the cylinder block 30 with the first injection portion 85*a* oriented substantially upwardly.

As shown in FIG. 2, even though the piston 62 moves along the cylinder axis line C0, the first nozzle 85, as compared with the second nozzle 90, continues to inject the oil OL towards a portion A1 of the back face 69 of the piston 62 adjacent (forwardly adjacent) the exhaust port 35. Where the number of exhaust ports is one, the first nozzle 85 injects the oil towards the geometric center of the exhaust port, but where a plurality of exhaust ports are juxtaposed relative to each other in a lateral direction on a front side, the first nozzle 85 injects the oil to a point intermediate between the geometric center of the one exhaust port and the geometric center of the other exhaust port. In the practice of the embodiment now under discussion, as shown in FIG. 7, two exhaust ports 35 are shown as employed, and the first nozzle 85 injects the oil OL towards the point intermediate between respective centers of the two exhaust ports 35 and 35. In other words, the first nozzle 85 injects the oil OL towards a center portion of the back face 69 of the piston 62, while accommodated within the cylinder bore 61, regardless of the position of the piston 62 then moving up and down within the cylinder bore 61.

Figure 9:
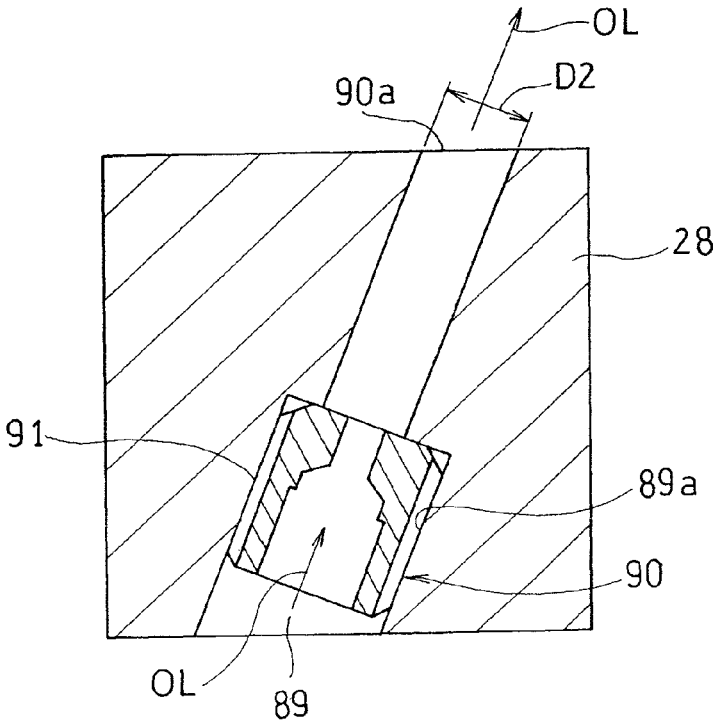
FIG. 9 is a schematic longitudinal sectional view showing a second nozzle of the piston cooling structure.

The second nozzle 90 has a second injection port 90*a* formed in the wall surface of the crankcase 28. Specifically, as shown in FIG. 9, the second nozzle 90 is in the form of a tubular body having its outer peripheral surface formed with a male threaded portion 91*a*. With the second nozzle 90 of the tubular body inserted from below into the outlet passage 89 of the crankshaft bearing cooling passage 86 (best shown in FIG. 6), the male threaded portion 91 is fastened to a female threaded portion 89*a* formed in the outlet passage 89. By so doing, the second nozzle 90 is fitted to the crankcase 28. The outlet passage 89 has an outlet end (upper end) forming the second injection port 90*a* of the second nozzle 90.

The second injection port 90*a* shown in FIG. 10 is preferably spaced from the cylinder axis line C0 in the radial direction a distance within the range of about 0.85 r to 1.05 r and, more preferably, within the range of about 0.90 r to 1.00 r relative to the radius r of the piston 62, but in the practice of the embodiment now under discussion, the distance of such spacing is chosen to be about 0.95 r. The position of the second injection port 90*a*, shown in FIG. 7, in the direction parallel to the cylinder axis line C0 is preferably spaced downwardly (adjacent to the axis of the crankshaft) from a top face of a crank web 106*a*, then held at the bottom dead center, a distance within the range of 0.26 r to 0.80 r (about 10 to 30 mm) and, more preferably, within the range of 0.40 r to 0.66 r (about 15 to 25 mm), but in the practice of the embodiment now under discussion, the distance of such spacing is chosen to be about 0.53 r (about 20 mm).

If the position in the direction parallel to the axis line is such as discussed above, the second injection port 90*a* is close to the piston 62 and, accordingly, the oil OL can be intensively injected onto an injection target portion of the piston 62 without being diffused, and also the oil OL can be smoothly injected without being disturbed by the crank web 106. In order to maintain the preferred second angle of inclination θ2 and the preferred axis line direction position, the second injection port 90*a* is preferably spaced a distance of about 0.85 r to 1.05 r and, more preferably, about 0.90 to 1.00 r in the radial direction from the cylinder axis line C0.

The second nozzle 90 shown in FIG. 7 injects the oil OL towards a portion of the back face 69 of the piston adjacent to the exhaust port 35 when the piston 62 is brought to the top dead center. On the other hand, when the piston 62 is at the bottom dead center, the second nozzle 90 injects the oil OL towards a side portion A2 of the back face 69 of the piston 62. In the practice of the embodiment now under discussion, when the piston 62 is at the top dead center, the second nozzle 90 injects the oil OL towards a region (the portion A1 referred to previously) intermediate between a pair of the exhaust ports 35.

The first injection port 85*a* is disposed radially inwardly of the second injection port 90 with respect to the cylinder CY. This first injection port 85*a* is also disposed at a position close to the piston 62, rather than to the second injection port 90*a*, with respect to the direction of the cylinder axis line C0. On the other hand, the second injection port 90*a* is disposed adjacent the second crank web 106 on one side opposite to a first crank web 104, where a crank gear 102 is formed, with respect to the connecting rod 64. The crank gear 102 serves to transmit a rotational force to a clutch (not shown).

Whereas the oil OL is directly supplied to the first nozzle from the oil cooler 60 (best shown in FIG. 4), the oil, which has been used to cool the bearing portion 88 for the crankshaft 26, is supplied to the second nozzle 90. Accordingly, the oil OL supplied to the first nozzle 85 has a temperature lower than that of the oil OL that is supplied to the second nozzle 90.

The first injection port 85*a* of the first nozzle 85 shown in FIG. 8 has a first bore size D1 so chosen as to be smaller than a second bore size D2 of the second injection port 90*a* of the second nozzle 90, that is, D1<D2. With the injection port so throttled, a first supply pressure P1 of the oil OL supplied to the first nozzle 85 is so chosen as to be higher than a second supply pressure P2 of the oil OL supplied to the second nozzle 90, that is P1>P2. Accordingly, a second injection amount Q2 of the second nozzle 90 is chosen so as to easily become larger than a first injection amount Q11 of the first nozzle 85, that is, Q1<Q2. It is noted that the wording "the first and second injection amount Q1 and Q2" means an injection amount per unit time When the combustion engine E rotates, the oil pump 56 shown in FIG. 5 is also driven in operative association therewith. The oil OL discharged from the oil pump 56 is, after having been purified by the oil filter 58, supplied into the oil cooler 60.

A portion of the oil OL having been purified by the oil filter 58 is supplied to the input and output shafts 13*a* and 13*b* of the transmission 13, shown in FIG. 3, the supercharger 42 and others after having passed through the lubricating passage 80 and without passing through the oil cooler 60.

Also, the cooled oil OL is supplied from the downstream side of the oil cooler 60, shown in FIG. 4, to the engine body through the cooling passage 78. Specifically, the oil OL flowing through the first branch passage 82 of the cooling passage 78 is used for blowing onto the piston 62 shown in FIG. 7. Also, the oil OL flowing through the second branch passage 84 (shown in FIG. 4) of the cooling passage 78 is, after having been used for lubrication of the bearing portion 88 for the crankshaft 26 in the crankcase 28, used for blowing onto the piston 62 and cooling of an inner wall surface of the cylinder CY shown in FIG. 3.

According to the construction hereinbefore described, the first nozzle 85 shown in FIG. 7 is such that the first angle of inclination θ1 thereof is so set as to be smaller than the second angle of inclination θ2 of the second nozzle 90, and injects the oil OL in substantially parallel relation with the cylinder axis line C0. Accordingly, regardless of the positon of the piston 62 then reciprocatingly moving up and down, the oil OL can be intensively injected to a specific site of the back face 69 of the piston 62 and, more specifically, a portion P1 of the back face 69 of the piston 62 which is adjacent to the exhaust port 35.

On the other hand, the second nozzle 90 can inject the oil OL towards a wide range of the back face 69 of the piston 62 while the position of the oil OL to be blown onto the back face 69 of the piston 62 changes in dependence on the position of the piston 62 then reciprocatingly moving up and down. In this way, while the oil OL is intensively injected by the first nozzle 85 onto the portion of the back face 69 of the piston, then heated to a high temperature, adjacent to the exhaust port 35, the oil OL is injected by the second nozzle 90 onto a wide range of the back face 69 of the piston 62. As a result, the piston 62 can be efficiently cooled.

The first injection port 85*a* of the first nozzle 85 is disposed radially inwardly of the second injection port 90*a* of the second nozzle 90 with respect to the cylinder CY. Accordingly, it is easy to position the first injection port 85*a* of the first nozzle 85 so that the first angle of inclination θ1 of the first nozzle 85 may become smaller than the second angle of inclination θ2 of the second nozzle 90.

The second nozzle injects the oil OL towards the portion of the back face 69 of the piston 62 adjacent the exhaust port 35 when the piston 62 is at the top dead center (at a position shown on left and right end sides of FIG. 7). Accordingly, even with the second nozzle 90, in addition to the piston 62 in its entirety, in the vicinity of the top dead center at which a high temperature is attained, the portion of the piston 62 adjacent the exhaust port 35 can be effectively cooled.

The first injection port 85*a* of the first nozzle 85 is disposed close to the piston 62 rather than to the second injection port 90*a* of the second nozzle 90 with respect to the direction parallel to the cylinder axis line C0. Accordingly, even when the distance from the first injection port 85*a* to the piston 62 is large as a result of the piston 62 arriving at the top dead center, the intensive cooling by means of the first nozzle 85 can be easily continued.

The first injection port 85*a* of the first nozzle 85 is constituted by a pipe protruding from the cylinder wall surface in a direction radially inwardly of the cylinder. Accordingly, the first injection port 85*a* of the first nozzle 85 can be disposed in proximity to the piston 62.

The oil OL is supplied to the first nozzle 85 through the first branch passage 82 ramified in one way from the cooling passage 78 shown in FIG. 4, and the oil OL is supplied to the second nozzle 90 (shown in FIG. 7) through the second branch passage 84 ramified in the other way from the cooling passage 78. The entire amount of the oil OL flowing in the first branch passage 82 is supplied to the first nozzle 85 (shown in FIG. 7) and a portion of the oil OL flowing in the second branch passage 84 is supplied to the second nozzle 90 (shown in FIG. 7). Accordingly, it is easy to set the first supply pressure P1 of the oil OL supplied to the first nozzle 85 shown in FIG. 7 to a value higher than the second supply pressure P2 of the oil OL supplied to the second nozzle 90. As a result thereof, even when the piston 62 is at a separated positon (top dead center), a high temperature portion of the piston 62 can be effectively cooled by the first nozzle 85.

Also, the first branch passage 82 is preferably short as compared with the second branch passage 84. Accordingly, since the friction loss in the passage is reduced to a small value, the first supply pressure P1 of the oil OL supplied to the first nozzle 85 can be easily set to a high pressure as compared with the second supply pressure P2.

The oil OL, which has been used to cool the bearing portion 88 for the crankshaft 26, is supplied to the second nozzle 90. Accordingly, the passage through which the oil OL is supplied to the second nozzle 90 can be concurrently used as the crankshaft bearing cooling passage 86 and, therefore, the structure can be simplified. Also, since the temperature of the oil OL supplied to the first nozzle 85 becomes lower than the temperature of the oil OL supplied to the second nozzle 90, the portion adjacent to the exhaust port 35, which is apt to be heated to a high temperature, can be effectively cooled.

The second injection port 90*a* of the second nozzle 90 is disposed in the neighborhood of the second crank web 106 on one side opposite to the first crank web 104 where the crank gear 102 is formed. Accordingly, the oil OL flowing towards the piston 62 can be prevented from interfering with the crank gear 102.

The first bore size D1 (shown in FIG. 8) of the first injection port 85*a* of the first nozzle 85 is set to a value smaller than the second bore size D2 (shown in FIG. 9) of the second injection port 90*a* of the second nozzle 90. Accordingly, the injection pressure of the oil OL injected from the first injection port 85*a* becomes higher than the injection pressure of the oil OL injected from the second injection port 90*a*. Therefore, even when the piston 62 is held at a separated position (top dead center), the high temperature portion of the piston 62 can be effectively cooled by the oil OL from the first nozzle 85 and throttled thin. Also, by a different method, the first supply pressure P1 of the oil OL to be supplied to the first nozzle 85 may be set to a value higher than the second supply pressure P2 of the oil OL to be supplied to the second nozzle 90.

The second injection amount Q2 of the second nozzle 90 is set to a value larger than the first injection amount Q1 of the first nozzle 85. Therefore, the back face 69 of the piston 62 and the cylinder bore 61 can be cooled in a wide range by the second nozzle 90.

As hereinabove discussed, in the practice of the present invention, the oil OL is injected intensively onto the particular site, and also the injection is possible in a wide range. Accordingly, even when a bias occurs in the temperature distribution of the back face 69 of the piston, the oil OL can be injected by the first and second nozzles 85 and 90 towards both of a high temperature portion and a low temperature portion, respectively. As a result, the piston 62 can be cooled efficiently with a minimized liquid amount so as to suppress the temperature rise of the piston 62.

In the event that any bias occurs in the temperature distribution of the back face 69 of the piston, depending on the bias in the temperature distribution, either one of the intensive injection towards the specific site and a diffusive injection over the wide range will make it difficult to sufficiently lower the temperature of the piston 62 with a minimized liquid amount. In contrast thereto, since in the practice of the present invention, both of the intensive injection towards the specific site and the diffusive injection over the wide range are performed, the oil OL can be injected in dependence on the bias in the temperature distribution. As a result, while the amount of the oil OL to be injected is reduced, the temperature rise of the piston 62 can be efficiently suppressed.

In this case, of the back face 69 of the piston, the oil OL is preferably injected by the first nozzle 85 towards a portion tending to become high in temperature. For example, the oil OL is injected by the first nozzle 85 towards the portion adjacent the exhaust port. In this way, the oil OL can be continuously injected by the first nozzle 85 intensively towards the high temperature portion, and also the oil OL can be diffusively injected by the second nozzle 90 towards a low temperature portion around the high temperature portion. Accordingly, the temperature rise of the piston 62 can be suppressed while occurrence of deficiency in the liquid amount is prevented.

The first nozzle 85, as compared with the second nozzle 90, can continue injecting the oil OL towards the specific site of the piston back face 69 with no change occurring in position, at which the oil OL is applied, in the event of a change in position of the piston 62. On the other hand, the second nozzle 90, as compared with the first nozzle 85, is susceptible to change in position, at which the oil OL is injected towards the piston back face 69, in dependence on the position of the piston 62. Accordingly, the second nozzle 90 can inject the oil OL in a wide range of the piston back face 69.

In the meantime, it is preferred that while the oil OL is continuously injected by the first nozzle 85 onto a specific site of the piston back face 69 that is determined beforehand, the oil OL can also be injected by the second nozzle 90 onto such predetermined specific site. By so doing, the temperature rise of the specific site of the piston back face 69 during a high temperature time can further be suppressed. In the practice of the above described embodiment of the present invention, at the top dead center, the oil OL is injected onto such predetermined specific site by means of the first nozzle 85 and the second nozzles 90, but at any position other than the top dead center, the second nozzle 90 injects the oil OL at a site different from the predetermined specific site. It is, however, to be noted that, at any position other than the top dead center, the injection target side of the first nozzle 85 and the injection target site of the second nozzle 90 may overlap with each other.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although in describing the preferred embodiment of the present invention, reference has been made to the four cylinder, four stroke parallel multi-cylinder combustion engine, the present invention is not necessarily limited thereto and may be applied to an in-line cylinder combustion engine or a V-type twin cylinder combustion engine, or to a two cylinder combustion engine or a single cylinder combustion engine. Also, the cylinder axis line may not extend in a manner such as described in connection with the preferred embodiment of the present invention, may extend in a vertical direction, a horizontal direction or any direction relative to the vertical direction or relative to the horizontal direction.

Also, the piston cooling structure of the present invention can be equally applied not only to the motorcycle, but also to any automotive vehicle or a marine engine, but also to a ground installed engine. Moreover, although the cooling structure of the present invention is suitably employed in a high output engine having a supercharger mounted thereon, particularly the combustion engine having the displacement not smaller than 600 cc, it can be applied to any a vehicle having no supercharger mounted thereon.

Accordingly, such changes and modifications are, unless they depart from the scope of the present invention as delivered from the claims annexed hereto, to be construed as included therein.

REFERENCE NUMERALS

26 . . . Crankshaft
28 . . . Crankcase
35 . . . Exhaust port
61 . . . Cylinder bore
62 . . . Piston
69 . . . Piston back face
78 . . . Cooling passage
82 . . . First branch passage
84 . . . Second branch passage
85 . . . First nozzle
85*a* . . . First injection port
88 . . . Bearing
90 . . . Second nozzle
90*a* . . . Second injection port
102 . . . Crank gear
104 . . . First crank web
106 . . . Second crank web
θ1 . . . First angle of inclination
θ2 . . . Second angle of inclination
CO . . . Cylinder axis line
CY . . . Cylinder
D1 . . . First bore size
D2 . . . Second bore size
E . . . Combustion engine
OL . . . Oil (Cooling liquid)

What is claimed is:

1. A piston cooling structure for a combustion engine which comprises:

first and second nozzles configured to inject a cooling liquid towards a back face of a piston which reciprocatingly moves along a cylinder axis line within a cylinder bore, the first and second nozzles having axes that are inclined at first and second angles relative to the cylinder axis line, respectively, in which the first angle of inclination relative to the cylinder axis line is set to a value smaller than the second angle of inclination relative to the cylinder axis line, and in which regardless of the position of the piston then reciprocatingly moving along the cylinder axis line, the first nozzle injects the cooling liquid intensively towards a portion of the back face of the piston, which portion is adjacent to an exhaust port, and the second nozzle has a second injection amount which is set to a value larger than a first injection amount of the first nozzle.

2. The piston cooling structure for the combustion engine as claimed in claim 1, in which the first nozzle has a first injection port and the second nozzle has a second injection port, the first injection port being disposed radially inwardly of the second injection port with respect to the cylinder bore.

3. The piston cooling structure for the combustion engine as claimed in claim 1, in which when the piston is at the top dead center, the second nozzle injects the cooling liquid towards a portion of the back face of the piston adjacent an exhaust port.

4. The piston cooling structure for the combustion engine as claimed in claim 1, in which the cooling liquid is supplied to the first nozzle through a first branch passage ramified in one direction from a point of ramification preset in a cooling passage, in which the cooling liquid is supplied to the second nozzle through a second branch passage ramified in the other way from the point of ramification preset in the cooling passage, and in which the cooling liquid flowing through the first branch passage has a temperature set to a lower value than the temperature of the cooling liquid flowing through the second branch passage.

5. The piston cooling structure for the combustion engine as claimed in claim 1, in which the entire amount of the cooling liquid branched in one way from a preset point of ramification defined in a cooling passage is supplied to the first nozzle, and in which a portion of the cooling liquid branched in the other way from the preset point of ramification defined in the cooling passage is supplied to the second nozzle.

6. The piston cooling structure for the combustion engine as claimed in claim 1, in which the combustion engine comprises:

a crankshaft drivingly connected with the piston; and a crankcase to support the crankshaft, in which a portion of the cooling liquid supplied to a bearing for the crankshaft is supplied to the second nozzle.

7. The piston cooling structure for the combustion engine as claimed in claim 1, wherein the combustion engine comprises:

a crankshaft drivingly connected with the piston; and a crankcase to support the crankshaft, wherein the second nozzle has a second injection port disposed proximate to a second crank web on one side opposite to a first crank web which is provided in the crankshaft and in which a crank gear is formed.

8. The piston cooling structure for the combustion engine as claimed in claim 1, in which a first supply pressure of the cooling liquid supplied to the first nozzle is set to a value higher than a second supply pressure of the cooling liquid supplied to the second nozzle, and in which the first nozzle has a first injection port defined therein and the second nozzle has a second injection port defined therein, the first injection port having a first bore size which is set to a value smaller than a second bore size of the second injection port.

9. The piston cooling structure for the combustion engine as claimed in claim 1, wherein:

the first nozzle injects the cooling liquid towards a center portion of the back face of the piston regardless of the position of the piston then moving along the cylinder axis line, and the second nozzle injects the cooling liquid towards a side portion of the back face of the piston which is positioned at a bottom dead center.

10. The piston cooling structure for the combustion engine as claimed in claim 1, wherein:

the first nozzle injects the cooling liquid continuously towards a specific site of the back face of the piston, which is determined beforehand; and the second nozzle injects the cooling liquid towards the specific site of the piston which is positioned at a predetermined position.

11. The piston cooling structure for the combustion engine as claimed in claim 1, wherein:

the first nozzle injects the cooling liquid towards a high temperature portion of the back face of the piston, which portion tends to become high in temperature; and the second nozzle injects the cooling liquid diffusively towards a low temperature portion around the high temperature portion.

12. The piston cooling structure for the combustion engine as claimed in claim 1, in which the cooling liquid supplied to the first nozzle has a temperature set to a lower value than the temperature of the cooling liquid supplied to the second nozzle.

13. A piston cooling structure for a combustion engine which comprises:

first and second nozzles configured to inject a cooling liquid towards a back face of a piston which reciprocatingly moves along a cylinder axis line within a cylinder bore, the first and second nozzles having axes that are inclined at first and second angles relative to the cylinder axis line, respectively, in which the first angle of inclination relative to the cylinder axis line is set to a value smaller than the second angle of inclination relative to the cylinder axis line, in which the combustion engine comprises:

a crankshaft drivingly connected with the piston; and a crankcase to support the crankshaft, in which a first injection port of the first nozzle is constituted by a pipe fluidly connected with the cylinder and protruding radially inwardly of the cylinder from a cylinder wall surface, and in which a second injection port of the second nozzle is formed in a wall surface of the crankcase.

14. The piston cooling structure for the combustion engine as claimed in claim 13, in which a first supply pressure of the cooling liquid supplied to the first nozzle is set to a value higher than a second supply pressure of the cooling liquid supplied to the second nozzle.

15. The piston cooling structure for the combustion engine as claimed in claim 13, in which the first nozzle has a first injection port defined therein and the second nozzle has a second injection port defined therein, the first injection port having a bore size which is set to a value smaller than a bore size of the second injection port.

16. A piston cooling structure for a combustion engine which comprises:

first and second nozzles configured to inject a cooling liquid towards a back face of a piston which reciprocatingly moves along a cylinder axis line within a cylinder bore, the first and second nozzles having axes that are inclined at first and second angles relative to the cylinder axis line, respectively, in which the cooling liquid supplied to the first nozzle has a temperature set to a lower value than the temperature of the cooling liquid supplied to the second nozzle, in which a first supply pressure of the cooling liquid supplied to the first nozzle is set to a value higher than a second supply pressure of the cooling liquid supplied to the second nozzle, or in which the first nozzle has a first injection port defined therein and the second nozzle has a second injection port defined therein, the first injection port having a bore size which is set to a value smaller than a bore size of the second injection port.

17. The piston cooling structure for the combustion engine as claimed in claim 16, in which the first nozzle has a first injection port and the second nozzle has a second injection port, the first injection port being disposed closer to the piston than the second injection port with respect to a direction of the cylinder axis line.

18. The piston cooling structure for the combustion engine as claimed in claim 16, in which the first angle of inclination relative to the cylinder axis line is set to a value smaller than the second angle of inclination relative to the cylinder axis line.

* * * * *